US007208081B2

(12) United States Patent
Jones

(10) Patent No.: US 7,208,081 B2
(45) Date of Patent: Apr. 24, 2007

(54) GUTTER FOAM FILTER

(76) Inventor: Robert W. Jones, 1214 Kelley St., Vienna, VA (US) 22180

( * ) Notice: Subject to any disclaimer, the term of this patent is extended or adjusted under 35 U.S.C. 154(b) by 0 days.

(21) Appl. No.: 10/751,510

(22) Filed: Jan. 6, 2004

(65) Prior Publication Data

US 2005/0145560 A1 Jul. 7, 2005

(51) Int. Cl.
*B01D 35/02* (2006.01)

(52) U.S. Cl. ..... 210/162; 52/12; 52/309.4; 210/473; 210/483; 210/510.1

(58) Field of Classification Search ..... 210/162, 210/163, 460–469, 473, 474, 483, 499, 477, 210/510.1, 461–9, 473–4; 52/11–13, 309.4; 405/118

See application file for complete search history.

(56) References Cited

U.S. PATENT DOCUMENTS

| | | | | |
|---|---|---|---|---|
| 3,507,396 | A * | 4/1970 | Homa | 210/477 |
| 3,855,132 | A | 12/1974 | Dugan | 210/455 |
| 3,947,362 | A * | 3/1976 | Etani | 210/416.2 |
| 4,841,686 | A | 6/1989 | Rees | 52/12 |
| 4,949,514 | A | 8/1990 | Weller | 52/12 |
| 5,103,601 | A | 4/1992 | Hunt | 52/12 |
| 5,242,591 | A | 9/1993 | Beechert et al. | 210/474 |
| 5,522,183 | A * | 6/1996 | Allen | 52/12 |
| 5,536,406 | A * | 7/1996 | Silva | 210/460 |
| 5,595,027 | A | 1/1997 | Vail | 52/12 |
| 6,932,911 | B1 * | 8/2005 | Groth et al. | 210/747 |
| 2003/0046876 | A1 | 3/2003 | Higginbotham | 52/11 |
| 2005/0034376 | A1 * | 2/2005 | Pourdeyhimi et al. | 52/11 |
| 2005/0178072 | A1 * | 8/2005 | Olthoff | 52/12 |

FOREIGN PATENT DOCUMENTS

| | | |
|---|---|---|
| CH | 661312 | 7/1987 |

OTHER PUBLICATIONS

U.S. Appl. No. 60/448,082, filed Feb. 18, 2003, Specification and Drawings, Groth et al.*

* cited by examiner

*Primary Examiner*—Joseph Drodge
(74) *Attorney, Agent, or Firm*—Richard C. Litman

(57) ABSTRACT

The gutter foam filter elements are generally triangular, four-foot lengths of flexible plastic open-cell foam material placed in and extending the full length of a conventional "K" type or similar roof gutter. The foam filter elements may be inserted within the gutter below gutter spikes. The foam material is an open-pore polyether foam of 10–20 cells per square inch which allows rainwater to travel through the filter while excluding leaves. The foam is generally in the form of a right triangle and so disposed in the gutter as to have one side extending along the back of the gutter and the other side of the triangle spanning the open space across the upper open portion of the gutter. The sloped wall defines a void in the lower front portion of the gutter for rainwater flow to a downspout. The lower corner of the element is truncated forming a lower support wall.

9 Claims, 3 Drawing Sheets

GUTTER FOAM FILTER

BACKGROUND OF THE INVENTION

1. Field of the Invention

The present invention relates to rain gutters for houses or the like. More particularly, the present invention relates to rain gutters having structure to prevent blocking of the gutters by foreign materials.

2. Description of the Related Art

Rain gutters, commonly installed along the lower edges of a sloping roof under the eaves to catch water draining from the roof, frequently become clogged with leaves, paper scraps and the like, carried to the roof by wind or gravity and washed into the gutter. This debris fills and clogs the gutters, causing water to overflow, and plugs downspouts, producing overflow of the gutter and downspout system.

Many devices have been proposed to overcome this problem, such as perforated plates and screens, designed to collect and divert leaves and debris before they are carried into the gutters and the downspout system. Leaves often become caught and embedded in the perforations and openings of such, structures, however, and must be removed by hand to prevent clogging. Also, such systems add substantial expense to the gutter and downspout system. The use of rigid open-cell foam within the gutter is known. Known rigid foam systems either require a special gutter shape, provide inadequate drainage, or are of a complex shape making them expensive to make and install. They may be subject to clogging with pollen or dust.

U.S. Patent Application Publication 2003/0046876 A1, Published Mar. 13, 2003, for Edward A Higgenbotham, describes a self-cleaning gutter shield made of sheet or extruded plastic which is placed over the upward opening of a gutter.

U.S. Pat. No. 3,855,132, issued Dec. 17, 1974, to Dugan describes a gutter designed to hold a reticulated, porous polyurethane foam, one embodiment having spacers between the foam and the bottom wall of the gutter to allow flow to the downspout.

U.S. Pat. No. 4,841,686, issued Jun. 27, 1989, to Rees, describes a filter attachment fitting over a gutter and having an elongated screen, the underside of which has a clamped pad of fiberglass.

U.S. Pat. No. 4,949,514, issued Aug. 21, 1990, to Weller, describes a rain gutter liner which is made of flexible foam such as reticulated polyurethane which has a relatively complex shape and is preferably folded on the job site to fit a particular rain gutter configuration.

U.S. Pat. No. 5,103,501, issued Apr. 14, 1992, to Hunt, describes a trilateral gutter guard of metal mesh which fits inside the rain gutter below its supports.

U.S. Pat. No. 5,242,591, issued Sep. 7, 1993, to Beechert et al, describes a filter or screen system which fits into a conventional rain gutter and which are made of flexible, resilient, durable corrosion resistant strands of material such as high-density polyethylene.

U.S. Pat. No. 5,595,027, issued Jan. 21, 1997, to Vail describes a gutter protector which is made of a flexible sheet which is curved over to fit within a rain gutter. A filter element is fitted under the apex area of the sheet with drain holes leading through the sheet and the filter to the interior of the gutter.

Swiss Patent No. CH661312, Published Jul. 15, 1987, describes a rainwater gutter having an open-cell foam material shaped such as to cover the open upper side of the gutter and defining a channel between the foam material and the bottom of the gutter for passing rainwater, the cells being of a small size so as to provide clean water.

None of the above inventions and patents, taken either singly or in combination, is seen to describe the instant invention as claimed. Thus a gutter foam filter solving the aforementioned problems is desired.

SUMMARY OF THE INVENTION

The gutter foam filter elements of the present invention are generally triangular lengths of plastic foam material placed in and extending the length of a conventional "K" type gutter located at the base of the roof of a dwelling or other building. The foam material is preferably supplied in four-foot sections and the required number of sections of foam are stuffed within the gutter so as to extend its full length. The foam filter elements may be inserted below gutter spikes where those are used in the mounting of the gutter to the wall of the building. The foam material is an open pore foam such as porous polyether foam of about 10–20 cells per square inch. The foam is flexible and easily cut to fit a desired length. The gutter foam filter allows rainwater to travel through the filter while excluding leaves which blow away when dry.

The foam is generally in the form of a right triangle in cross section and so disposed in the gutter as to have a rear side of the right triangle extending along the back of the gutter and an upper side of the triangle spanning the open space between the upper lip of the front wall and the rear upper wall forming the open portion of the gutter. The angular side forming the hypotenuse of the triangle extends from the lower rear wall to the upper front wall, leaving a void in the lower front portion of the gutter for rainwater to flow to a downspout. The lower corner of the foam element is preferably truncated so as to partially extend outward, parallel to the upper side, from the gutter back wall and along its bottom wall to provide added stability to the foam element as located in the gutter structure.

The present invention provides improved elements and arrangements thereof for the purposes described and which is inexpensive, dependable and fully effective in accomplishing its intended purposes.

The features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
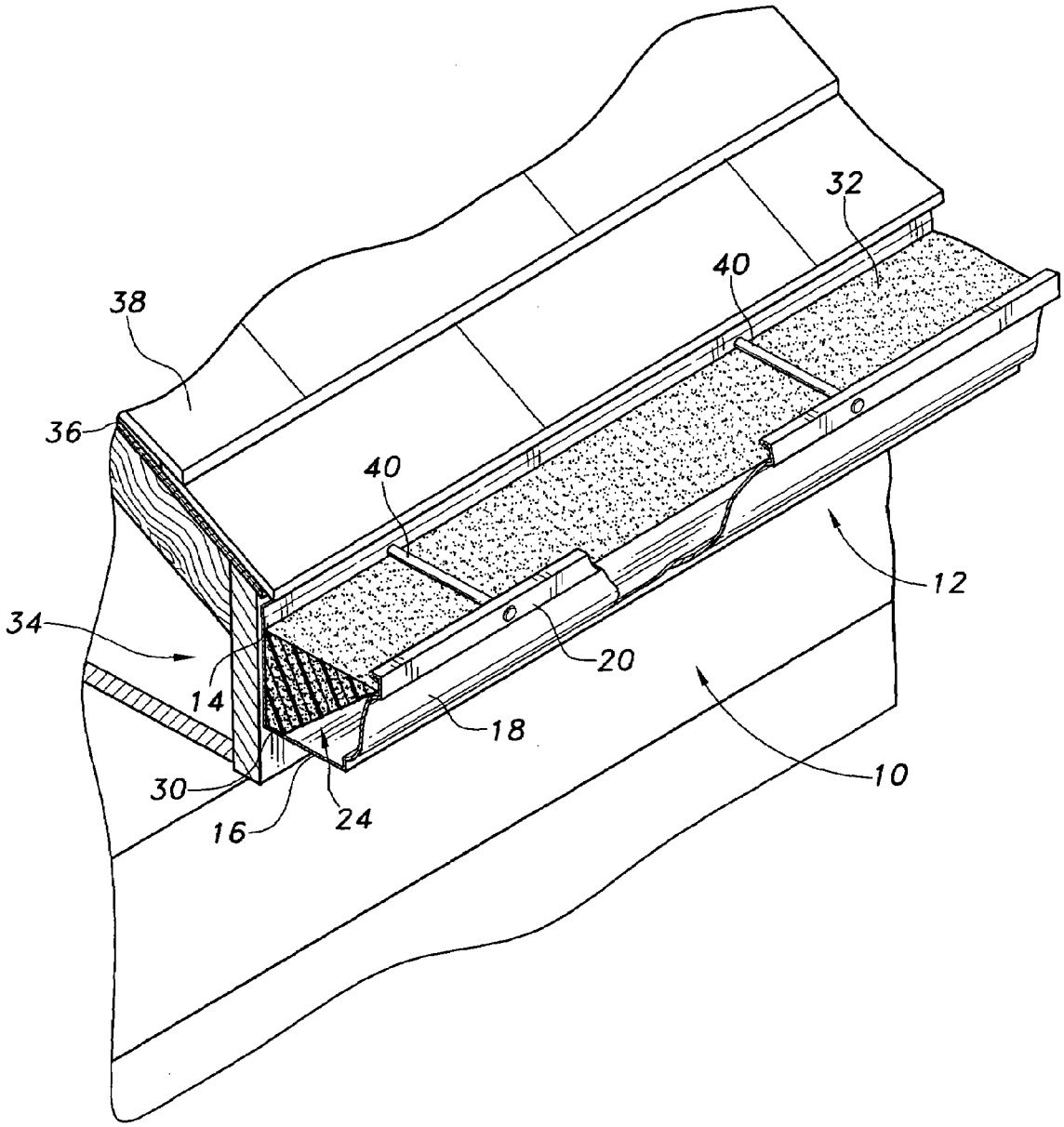
FIG. 1 is an environmental, perspective view of a section of a foam filter according to the present invention as installed in a "K"-type gutter having gutter spikes.

The gutter foam filter elements of the present invention are generally triangular lengths of plastic foam material placed in and extending the length of a conventional "K"

type gutter located at the base of the roof of a dwelling or other building. The foam material is preferably supplied in four-foot sections and the required number of sections of foam are stuffed within the gutter so as to extend its full length.

Referring to the Figures, the inventive gutter system is generally referred to by element number 10. Gutter system 10 includes gutter 12 which is connected at corners and leads to downspouts in a conventional manner. Gutter 12 has a back wall 14, a bottom wall 16, and a front wall 18. Gutter front wall 18 has an upper lip 20 having an inward and downward pointing inner lip portion 22. The space between the upper lip 20 and the back wall 14 is open to receive rainwater runoff from roof 36. The inventive foam filter insert 24 has the general cross section of a right triangle having an inner side 26, an outer angular side 28, serving as the hypotenuse of the right triangle, an upper side 32 and a lower side 30 formed by the truncation of the angle between the inner side 26 and the outer angular side 28 and extending parallel to the upper side 32.

The foam filter insert 24 is inserted into gutter 12 such that inner side 26 is located along back wall 14, the upper side 32 extends across and spans the space between the upper lip 20 and the back wall 14, the lower side 30 extends along the bottom wall 16 from back wall 14 to a point spaced forward of back wall 14, and the outer, angular side 32 extends from the forward point of lower side 30 to the outer corner of upper side 32 at the upper lip 20 of gutter 12. The void V, defined by the angular side 32 and the lower front portion of gutter 12 allows filtered water to flow uninhibited to a downspout (not shown) while leaves and other trash are trapped on the upper side 26 of filter elements 24.

Figure 2:
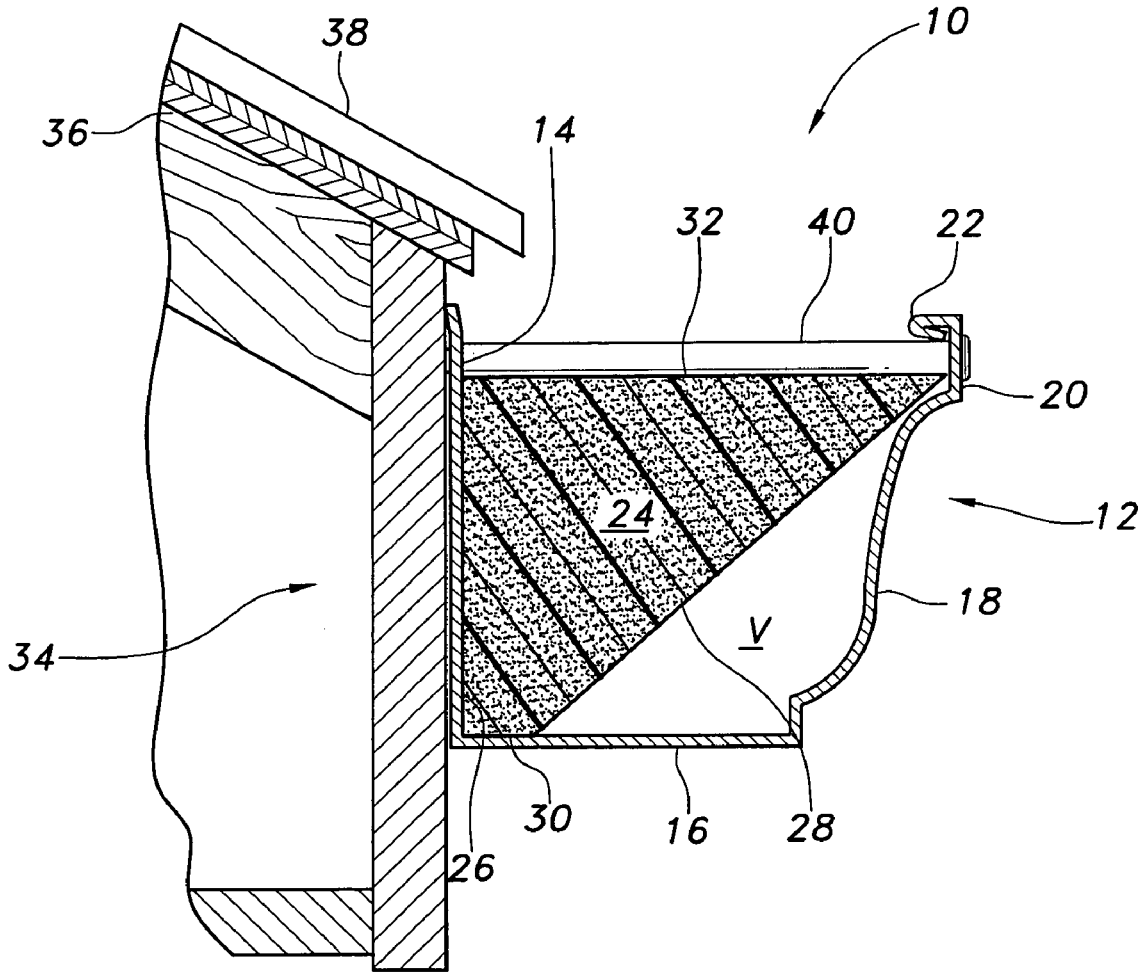
FIG. 2 is an end view of the section of gutter and foam filter of FIG. 1.
Figure 3:
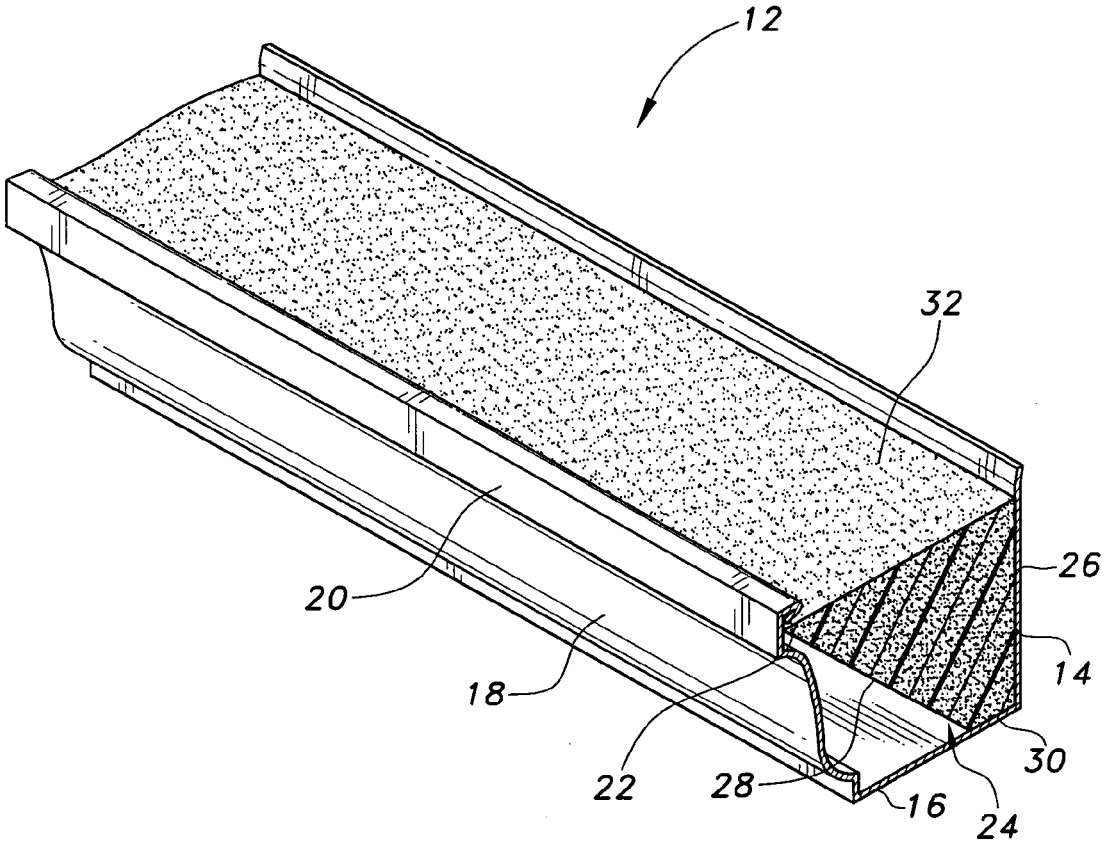
FIG. 3 is a perspective view of a section of foam filter according to the present invention as installed in a gutter without a gutter spike.

In a typical installation, as seen in FIGS. 1 and 2, gutter 12 is attached to the upper portion of building structure 34 under the eave or overhang of roof 36 having shingles 38. The gutter 12 is held in place by a plurality of spaced gutter spikes 40 extending between front upper lip 20 and through back wall 14 and secured in wooden building structure 34. As described above, the inventive filter elements are inserted in gutter 12, oriented as described above, and slid underneath the gutter spikes 40 to their permanent position. FIG. 3 illustrates a gutter 12 having foam filter element 34 installed therein without the presence of gutter spikes 40 where back wall 14 of gutter 12 is fastened to building structure 34 by alternative means.

In operation, rainwater from roof 36 drains through the filter element 24 and enters void V, while leaves and other debris collect on the upper side 32 of the filter element 24. The filtered water is directed to a downspout (not shown). The leaves and debris are blown away from the gutter by wind resulting in a gutter system 10 which requires little cleaning or maintenance by the homeowner.

The conventional "K"-type gutters are typically provided in 5" and 6" sizes. The size is measured between the back wall and the inner lip of the front wall. For a 5" size, a foam filter element according to the present invention has an upper side of about 5½" width and an inner side of about 3⅛" height with a lower side of about ¾" in width. These dimensions may be scaled up or down for larger or smaller size gutters. Also, the relative dimensions and the cross-section shape of the foam filter element may depart from that described, to fit a particular gutter as long as a substantial void is provided for flow of filtered water in the lower front portion of the gutter.

The open cell foam material is preferably of a polyether plastic material, however other materials are contemplated by the present invention. The preferred size range of cells is from about 10 to about 20 cells per square inch. The cells are of such size that material such as pollen or dust will wash through the inventive filter element with the rainwater so as not to clog the filter. The inventive filter elements are flexible and may easily be removed from the gutter, cleaned, and replaced into the gutter if any clogging occurs.

It is to be understood that the present invention is not limited to the embodiment described above, but encompasses any and all embodiments within the scope of the following claims.

I claim:

1. A combination filter insert and rain gutter comprising:

an elongated filter insert having a cross section in the form of a truncated right triangle and made of open cell foam porous material, said filter insert having a generally horizontal upper side with front and rear edges, a generally vertical rear side perpendicular to said upper side and having an upper edge coincident with said rear edge of said upper side and a lower edge, a generally flat, angled side extending between the front edge of said upper side to a lower forward edge proximate to and forward of the lower edge of said rear side and rearward of the upper side front edge, a lower side parallel with said upper side and extending forward from said lower edge of said rear side to said lower forward edge, said lower side of said filter insert being formed by the truncation of said filter insert between said rear side and said angled side; and a rain gutter having a back wall, a bottom wall, and a front wall, said front wall having an upper lip, an upper opening defined between said back wall and said front wall upper lip, said filter insert being inserted into said rain gutter such that said insert upper side spans said gutter upper opening between said back wall and said upper lip of said front wall, said rear side of said insert bearing against and coextensive with said gutter back wall, and said insert lower side bearing against said gutter bottom wall, said insert angled side extending between said lower side at said lower forward edge to said gutter front wall upper lip, wherein said angled side of said insert faces said front wall and said bottom wall of said gutter, and wherein a void having a substantially triangular-shaped cross section is defined between said angled side of said insert, said front wall and said bottom wall of said gutter, whereby liquid may enter said gutter upper opening and travel through said filter insert into said void, for flow to a gutter liquid outlet while leaves and other debris are trapped on the upper side of said filter insert.

2. The combined filter insert and gutter of claim 1, wherein said open cell porous foam material has from about 10 to about 20 cells per square inch.

3. The combined filter insert and gutter of claim 2, wherein said open cell porous foam material is flexible polyether foam.

4. The combined filter insert and gutter of claim 1, wherein said filter insert is about four feet in length.

5. The combined filter insert and gutter of claim 1, wherein said gutter has an inner lip portion extending inward and downward from said upper lip so as to bear against said upper side of said filter insert.

6. The combined filter insert and gutter of claim 1, wherein said gutter is mounted on a building structure below the eave of a roof such that rainwater draining from said roof enters said gutter through said filter insert upper side.

7. The combined filter insert and gutter of claim 6, further comprising a plurality of spaced gutter spikes extending through said gutter upper lip, across said span formed between said upper lip and said back wall, and through said back wall into said building structure for securing said gutter to said building structure, said filter insert fitting below said gutter spikes.

8. The combined filter insert and gutter of claim 1, wherein said filter insert is about four feet in length and a plurality of filter inserts are inserted end to end into a length of said gutter so as to extend the full length of said gutter.

9. The combined filter insert and gutter of claim 8 wherein said filter inserts are easily removed from the gutter for cleaning and are easily reinstalled into the gutter.

* * * * *